US010398991B2

(12) United States Patent
Vance et al.

(10) Patent No.: US 10,398,991 B2
(45) Date of Patent: Sep. 3, 2019

(54) SYSTEM AND METHODS FOR KINETIC ROTATION OF A RIDE VEHICLE

(71) Applicant: Universal City Studios LLC, Universal City, CA (US)

(72) Inventors: Eric Alan Vance, Orlando, FL (US); Michael Davies Habersetzer, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 15/606,846

(22) Filed: May 26, 2017

(65) Prior Publication Data

US 2018/0339234 A1 Nov. 29, 2018

(51) Int. Cl.

| | |
|---|---|
| ***A63G 21/18*** | (2006.01) |
| ***A63G 31/08*** | (2006.01) |
| ***A63G 1/24*** | (2006.01) |
| ***A63G 1/34*** | (2006.01) |
| ***A63G 31/00*** | (2006.01) |
| ***A63G 3/00*** | (2006.01) |
| *A63B 67/00* | (2006.01) |

(52) U.S. Cl.

CPC ..... *A63G 31/08* (2013.01); *A63G 1/24* (2013.01); *A63G 1/34* (2013.01); *A63G 3/00* (2013.01); *A63G 31/007* (2013.01)

(58) Field of Classification Search

CPC ..... A63G 21/00; A63G 21/18; A63G 31/00; A63G 31/007; A63B 67/007; A63B 2225/605; A63B 2208/12; A63B 2009/008

USPC ..... 472/117, 128, 129; 104/69–70

See application file for complete search history.

(56) References Cited

U.S. PATENT DOCUMENTS

| | | | | | |
|---|---|---|---|---|---|
| 4,836,521 | A | * | 6/1989 | Barber | A63G 3/02 104/86 |
| 5,113,702 | A | | 5/1992 | Capps | |
| 5,453,054 | A | * | 9/1995 | Langford | A63G 21/18 405/79 |
| 5,989,126 | A | * | 11/1999 | Kilbert | B63B 35/76 104/70 |
| 6,006,672 | A | | 12/1999 | Newfarmer et al. | |

(Continued)

FOREIGN PATENT DOCUMENTS

JP H05192450 A 8/1993

OTHER PUBLICATIONS

PCT/US2018/033737 Invitation to Pay Fees dated Sep. 12, 2018.

*Primary Examiner* — Kien T Nguyen

(74) *Attorney, Agent, or Firm* — Fletcher Yoder P.C.

(57) ABSTRACT

A ride system in accordance with present embodiments includes a flume providing a flow path and one or more vehicles configured to accommodate one or more passengers and configured to move along the flow path in the flume. The ride system also includes one or more objects protruding into the flow path, wherein the one or more objects are positioned in the flow path such that the one or more objects are configured to contact a vehicle of the one or more vehicles as the vehicle moves along the flow path and at a contact location on an exterior of the vehicle, wherein the contact location is spaced apart a distance from a center of mass of the vehicle to change a direction or orientation of the vehicle after the one or more objects contact the vehicle at the contact location.

16 Claims, 5 Drawing Sheets

(56) References Cited

U.S. PATENT DOCUMENTS

| | | | | |
|---|---|---|---|---|
| 6,045,449 | A * | 4/2000 | Aragona | A63B 67/007 472/117 |
| 7,731,595 | B2 * | 6/2010 | Hlynka | A63G 21/18 472/117 |
| 2010/0173717 | A1 | 7/2010 | Yule | |

* cited by examiner

SYSTEM AND METHODS FOR KINETIC ROTATION OF A RIDE VEHICLE

FIELD OF DISCLOSURE

The present disclosure relates generally to the field of amusement parks. More specifically, embodiments of the present disclosure relate to methods and equipment used in conjunction with amusement park games or rides.

BACKGROUND

Various forms of amusement rides have been used for many years in amusement or theme parks. These include traditional rides such as roller coaster, track rides, and water vehicle-based rides. Many rides may include techniques to reorient a vehicle of the ride. Such techniques may include complex and expensive mechanisms to produce some degree of rotation in the ride vehicle. These complex and expensive mechanisms may break down and require maintenance of the moving parts of the mechanisms. Further, such mechanisms may be difficult to refurbish or replace. Accordingly, there is a need to provide vehicle orientation adjustment through simple, reliable, and cost-efficient methods and devices in an amusement ride.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a system includes a flume providing a flow path; one or more vehicles configured to accommodate one or more passengers and configured to move along the flow path in the flume, wherein the one or more vehicles are associated with a length and a width, and the length is longer than the width; and one or more objects protruding into the flow path, wherein the one or more objects are positioned in the flow path such that the one or more objects are configured to contact a vehicle of the one or more vehicles as the vehicle moves along the flow path and at a contact location on an exterior of the vehicle, wherein the contact location is spaced apart a distance from a center of mass of the vehicle to change a direction or orientation of the vehicle relative to the flow path after the contact location of the vehicle contacts the one or more objects.

In another embodiment, a method includes the steps of providing a water-based flow path for a ride vehicle; providing a plurality of reorientation objects positioned within the flow path; and contacting the ride vehicle with the plurality of reorientation objects in series to change an orientation of the ride vehicle within the flow path.

In another embodiment, a method includes the steps of providing a water ride attraction comprising a flume forming a plurality of flow paths; providing one or more vehicles configured to move along the plurality of flow paths; providing one or more variable objects positioned within the flume, wherein each of the one or more variable objects is configured to be individually actuated between a first configuration and a second configuration within flume; contacting a first vehicle with an individual variable object in the first configuration at a first contact point on an exterior of the first vehicle to adjust a vehicle orientation of the first vehicle by a first displacement angle and to cause the first vehicle to enter a first flow path of the variety of flow paths; actuating the individual variable object to the second configuration; and contacting a second vehicle with an individual variable object in the second configuration at a second contact point on an exterior of the second vehicle to cause the second vehicle to change an orientation a second angular amount different from the first angular amount and to cause the second vehicle to enter a second flow path of the variety of flow paths.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
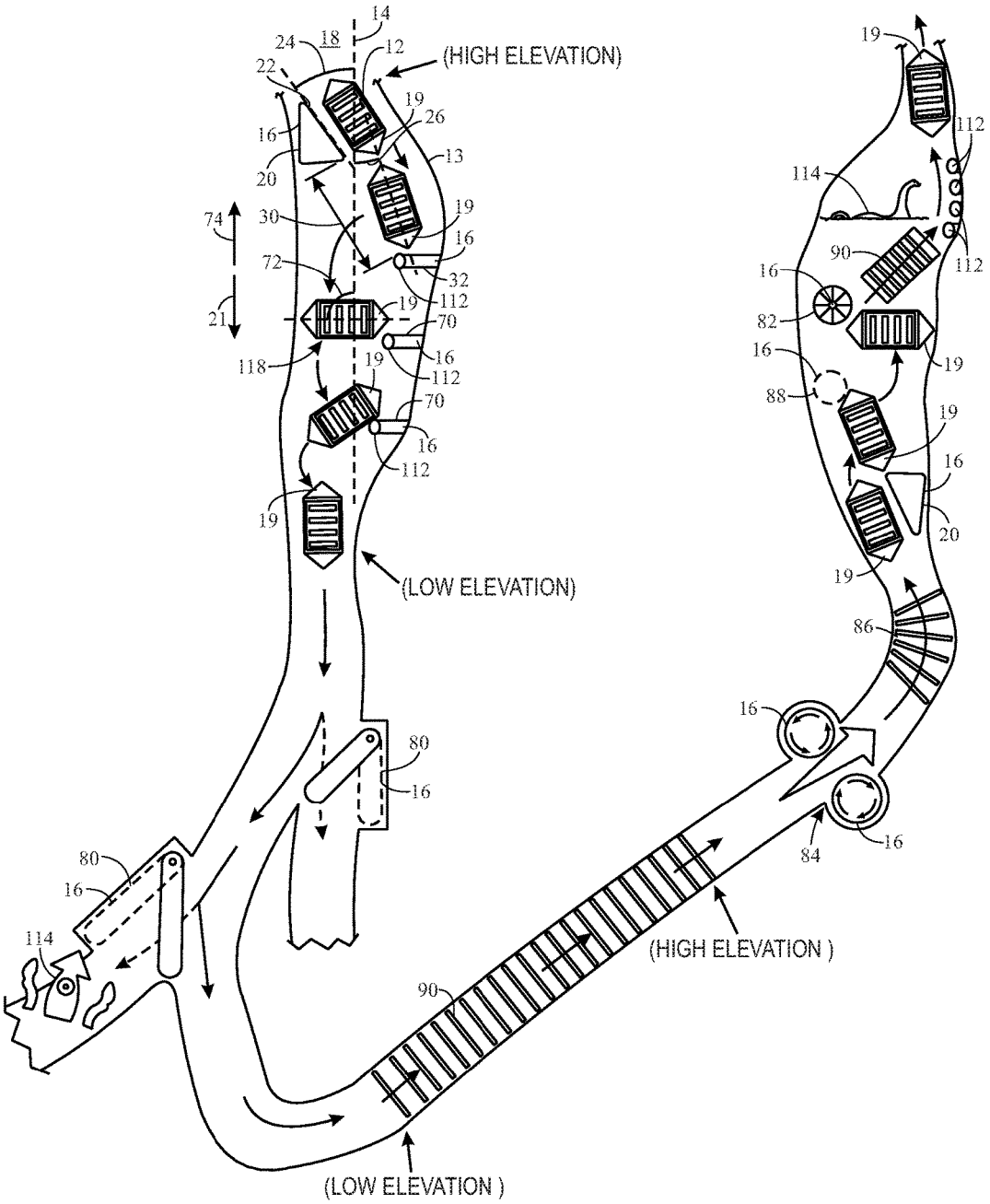
FIG. 1 is perspective view of a water ride attraction including an efficient rotation means in accordance with the present techniques.

The present disclosure provides a system and method to rotate a vehicle of an amusement park ride (e.g., water ride) that may, in certain embodiments, be implemented without mechanical components and/or steering components, either incorporated into the ride or onto the ride vehicle. For certain types of water rides, passengers in a ride vehicle travel within a flume that may provide walls defining the path of travel for the ride vehicle. The flume may be built to be only slightly larger than the vehicle such that the range of motion is limited by the side walls. The ride vehicles move under gravity and/or current power, and may not include a motor or steering capability. Accordingly, steering such vehicles may be challenging. Certain rides may provide a flume that creates a bend to turn the vehicle. However, implementing a turn using a flume path involves fixed structures and may take up valuable space in the amusement park. Further, such turns cannot be incorporated into water rides that are more open and in which the flume is significantly larger than the ride vehicle. Other types of rides may incorporate tracks or steering devices for the ride vehicles, which may be expensive and involve increased maintenance. This may result in costly repairs and extended downtime of a ride. Therefore, providing a water ride with a simple (e.g., non-mechanical) technique for vehicle rotation may increase a thrill factor of the ride without drastically increasing an overhead cost (e.g., power costs, repair costs, etc.).

In certain embodiments, amusement park rides such as water rides are provided that include one or more reorientation objects positioned along a flow path to induce rotation of the vehicle via contact with the vehicle. Momentum of the vehicle as it moves along the flow path may carry the vehicle to contact reorientation object or objects. Contact with the reorientation object or objects results in kinetic reorientation of the vehicle without steering and, in certain embodiments, without employing mechanical or actuating devices. The vehicle may contact the one or more objects at a location that is a specific distance from the vehicle's center of mass. Thus, once the vehicle contacts the one or more objects, the linear motion of the vehicle as it rides along the flow path may be transferred into rotational motion. The ride vehicle may continue to contact one or more of the objects until the ride vehicle has reached a desired degree of rotation. Accordingly, the vehicle may be a simple structure as well, without complex steering mechanisms.

By providing one or more reorientation objects within the amusement park rides that induce a desired amount of turning or reorientation without employing mechanical actuators, a ride vehicle may be oriented towards a desired pathway. Further, because such objects are not under power and may be mechanically simple, reconfiguring a ride may involve simply moving or rearranging the reorientation objects according to a desired updated configuration.

With the foregoing in mind, FIG. 1 illustrates a perspective view of a water ride attraction 10 that may induce kinetic reorientation of a ride vehicle. The water ride attraction 10 may include a vehicle 12 that moves within a flume 13 (e.g., water transport,) along a flow path 14. Indeed, the flow path 14 may be defined by the flume 13. As the vehicle 12 moves along the flow path 14, the vehicle 12 may contact (e.g., collide) with one or more objects 16 (e.g., pylons) along the flow path 14. In some embodiments, the one or more objects 16 may be permeable, thereby permitting fluid (e.g., water) to pass through the bodies of the one or more object 16. In some embodiments, the flow (e.g., force) of the flow path 14 may be a result of a current of water. The current of water may be generated via mechanical systems (e.g., a pump) and/or may be a result of the flume 13 being angled, thereby causing the water to flow as a result of gravitational force. In some embodiments, the flow path may 14 be a dry sloped path that the vehicle 12 may slide or roll along. Overall, the vehicle 12 may not utilize an internal power system (e.g., motor, engine, etc.) to produce movement. Moreover, the vehicle 12 may change direction (e.g., rotate) without the use of on-board steering or off-board mechanisms.

At a flow path entrance 18 of the flow path 14, the vehicle 12 may be positioned substantially parallel to the flow path 14 with a front side 19 of the vehicle 12 facing generally downstream 21. In some embodiments, the vehicle 12 may be angled (e.g. slanted) to some degree relative to the flow path 14 at the entrance 18. Regardless of the angle at which the vehicle 12 is disposed at the flow path entrance 18, the vehicle 12 may interact with a slanted object 20 disposed adjacent the flow path entrance 18. The slanted object 20 may include an angled edge 22 that is at a first angle 24 relative to the flow path 24. The vehicle 12 may slide along the angled edge 22, which may result in a rotation of the vehicle 12. Accordingly, the angled edge 22 may include a friction reducing mechanism (e.g., wheels, a smooth finish, a lubricated finish, bearings, etc.) to maintain a speed of the vehicle 12 while interacting with the slanted object 20. After the vehicle 12 has interacted with the slanted object 20 and has moved downstream 21 beyond the slanted object 20, the vehicle 12 may be moving along the flow path 14 while disposed at a second angle 26 relative to the flow path 14. Indeed, each successive vehicle 12 of the water ride attraction 10 may be disposed at the second angle 26 due to interaction with the slanted object 20. In other words, the slanted object 20 may consistently and accurately rotate each successive vehicle 12 to the second angle 26. There may be a clearance 30 between the slanted object 20 and a first object 32 disposed downstream 21 of the slanted object 20. The clearance 30 may be a distance equal to or greater than the length of the vehicle (e.g., vehicle length 34). Therefore, given the clearance 30, the vehicle 12 may flow easily between the slanted object 20 and the first object 32.

As discussed above, the vehicle 12 may be disposed at the second angle 26 after interaction with the slanted object 20 as it moves downstream 21 toward the first object 32. Given the predictable angle (e.g., second angle 26) of the vehicle 12 as it approaches the first object 32, the vehicle 12 may contact the first object 32 at a predictable location along the perimeter of the vehicle 12. In particular embodiments, the first object 32 or other objects 16 as provided herein may be fixed or immobile such that the vehicle 12 moves as a result of the contact but the first object 32 (or other object 16) does not.

Figure 2:
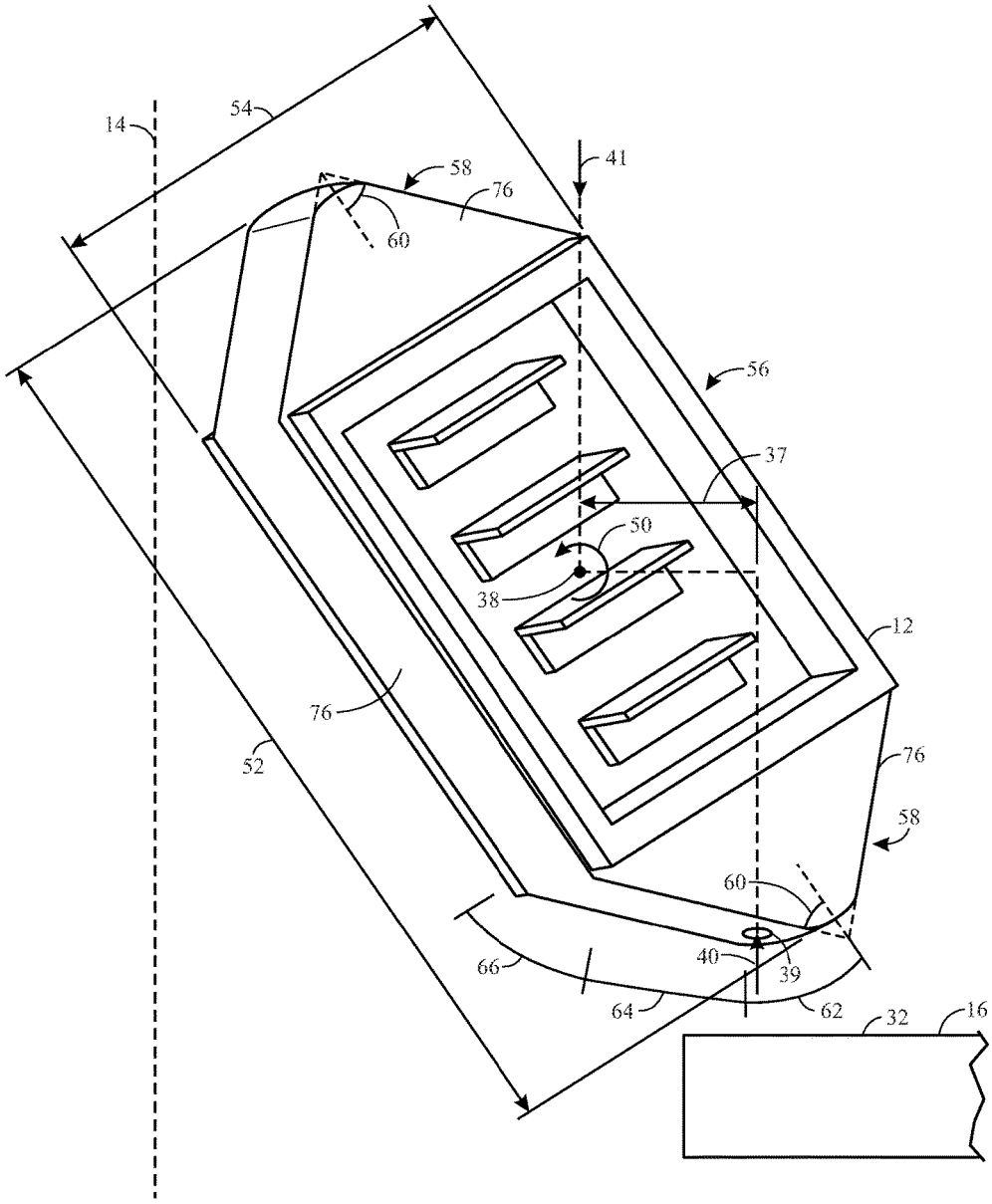
FIG. 2 is a perspective view of an embodiment of a ride vehicle, in accordance with the present techniques.

For example, as will be described in parallel with FIG. 2, the vehicle 12 may contact the first object 32 at a contact point 39 of the vehicle 12, which is located at a distance 37 away from a center of mass 38 of the vehicle 12. The distance 37 may be defined as the perpendicular distance of the contact point 39 away from the center of mass 38, relative to a direction of its momentum 41 (e.g., axis of travel) of the vehicle 12 as it moves along the flow path 14. In some embodiments, the center of mass 38 may be located in the center of the vehicle 12 and/or adjacent to the center of the vehicle 12. Particularly, it should be noted that the location of the center of mass 38 of the vehicle 12 may change in relation to loading of the vehicle 12. For example, in some embodiments, if an overall center of mass of passengers of the vehicle 12 is located away from the center of the vehicle 12, the center of mass 12 of the vehicle 12 may change accordingly. As such, it is to be understood that the center of mass 38 discussed herein may be associated with an approximate location relative to the vehicle 12 that is subject to change slightly based on certain circumstances (e.g., loading). In some instances, the direction of momentum 41 may be parallel to the flow path 14. Further, the contact point 39 may refer to a range of points, e.g., a region on the vehicle 12.

Overall, the vehicle 12 may approach the first object 32 with at least a portion of its momentum 41 parallel with the flow path 14. Once the vehicle 12 contacts the first object 32, the collision of the vehicle 12 with the first object 32 may cause the vehicle 12 to experience a reaction force 40 at the contact point 39. In this manner, the momentum 41 of the vehicle 12, in conjunction with the reaction force 40, may cause the vehicle 12 to experience a moment 50, resulting in rotational movement relative to the center of mass 38. Particularly, the moment 50 of the reaction force 40 (e.g., torque) at the contact point 39 may cause the vehicle 12 to rotate in the direction of the reaction force 40, relative to the center of mass 38. For example, in the current embodiment, the reaction force 40 may cause the vehicle 12 to rotate in a counter-clockwise direction. However, it is to be understood that the direction of rotation is a matter of design choice. As such, the vehicle 12 may be rotated the opposite direction (e.g., a clockwise direction) through contact on an opposite side the center of mass 38 of the vehicle 12. It should also be noted that, although the first object 32 and successive objects 70 are disposed perpendicular to the flow path 14, the first and successive objects 32, 70 may be disposed at any suitable angle relative to the flow path to produce the a desired change in orientation of the vehicle 12. Furthermore, the slanted object 20, the first object 32, the successive objects 70, or any combination thereof may be stationary and integral to the water ride attraction 10. Further, the slanted object 20, the first object 32, and/or the successive objects 70 may extend from the flume 13, or be stand-alone objects disposed a distance away from the flume 13.

Further, the vehicle 12 is associated with a length 52 and a width 54. The length 52 may be greater than the width 54. In some embodiments, the vehicle 12 may include a mid-section 56 and end-sections 58. In particular embodiments, the end-sections 58 may be substantially triangular with vertices of the end-sections 58 bisected by a line through the center of mass 38 and passing through the vertices. The bisected vertices may define a bisected vertex angle 60. Indeed, the contact point 39 may be located on a primary contact section 62 of the end-section 58 while the vehicle 12 is rotated counter-clockwise (as a result of interaction with the slanted object 20) to a degree between the bisected vertex angle 60 and parallel, relative to the flow path 14. If the vehicle 12 is rotated counter-clockwise to a degree equal to, or greater than, the vertex angle 60, the contact point 39 may be located on a secondary contact section 64, or a tertiary contact section 66, respectively. However, in some embodiments, the vehicle 12 may be in any suitable shape with the width 54 of the vehicle shorter than the length 52 of the vehicle. For example, the vehicle 12 may be generally oblong (e.g., rectilinear, curved), with the mid-section 56 and the end-sections 58 being well-defined. Therefore, regardless of the shape of the end-sections 58 of the vehicle 12, the contact point 39 may be at any suitable location along the length 52 of the vehicle 12 to produce a desired amount of rotation.

Figure 3:
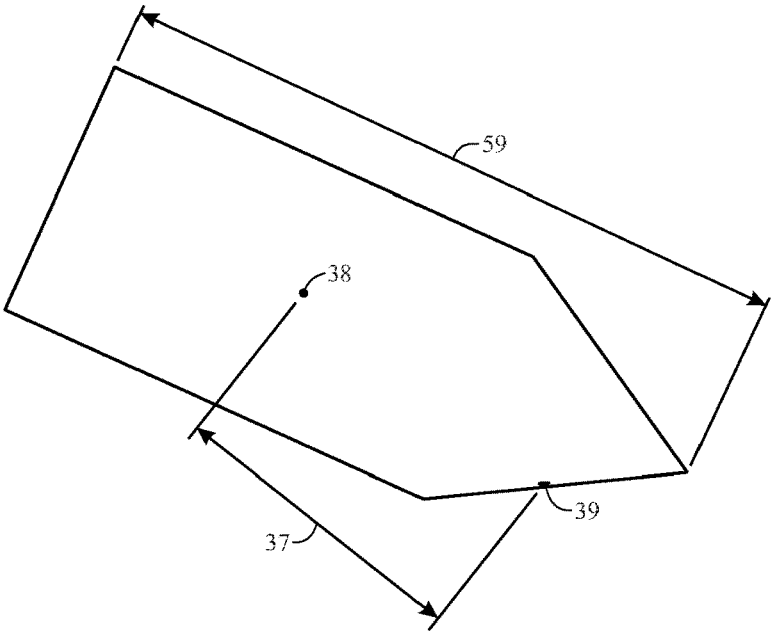
FIG. 3 is a perspective view of a ride vehicle, in accordance with the present techniques.

Referring to FIG. 3, the vehicle 12 and the flow path 14 may be configured such that the contact point 39 is spaced apart the distance 37 from the center of mass 38 that is at least a certain percentage of a longest dimension 59 of the vehicle 12. For example, the distance 37 may be at least 20%, at least 30%, at least 40%, or at least 50% of the longest dimension 59. Such a configuration may facilitate sufficient changes in orientation and may also reduce bumping or loss of momentum as a result of the contact.

Referring back to FIG. 2, after the vehicle 12 has contacted the first object 32 and has rotated some degree as discussed above, the vehicle 12 may contact one or more successive objects 70 to further torque (e.g., rotate) the vehicle 12. Particularly, after interacting (e.g., contacting) with the first object 32, the vehicle 12 may be disposed at a third angle or orientation as it approaches one of the successive objects 70. The orientation of the vehicle 12 may be assessed as a relative change in the orientation, e.g., orientation 72, to the flow path 14, which may be expressed as an angular change. For example, the change may be a change in an angle formed between the orientation 72 and a line parallel to the flow path 14, both extending from the center of mass or from a point on the vehicle 12. Indeed, the third angle 72 of the vehicle 12 may be consistent between cycles of the water ride attraction 10 as each successive vehicle 12 moves along the water ride attraction 10. In some embodiments, the vehicle 12 may continue to contact successive objects 70 until the vehicle 12 has been completely rotated, resulting in the front side 19 of the vehicle 12 facing upstream 74. In some embodiments, as mentioned above, the center of mass 38 of the vehicle 12 may change slightly based on passenger loading. As such, the degree of orientation change after contact with an object 16 may also change slightly between cycles of the water ride attraction 10. Regardless, enough successive objects 70 may be provided in the flow path 14 to rotate the vehicle 12 in order to incur the desired overall orientation change of the vehicle 12.

In this manner, through interaction with the objects 16 (e.g., first object 32 and successive objects 70), the vehicle 12 may be reoriented (e.g., rotated) by utilizing kinematic energy transfer as it moves through the water ride attraction 10. In other words, the linear motion (e.g., direction of momentum 41 of the vehicle 12 as it moves along the water ride attraction 10 may be interrupted (e.g., through contact) by one or more objects 16. The one or more objects 16 may contact the vehicle 12 at a location offset from the center of mass 38. The interruption of linear motion of the vehicle 12 in this way may cause the linear kinetic energy of the vehicle 12 to be transferred to rotational kinetic energy of the vehicle 12.

The vehicle 12 may completely reorient itself (e.g., relative to the position of the vehicle 12 at the flow path entrance 18), in that the front side 19 of the vehicle 12 may face upstream 74, as a result of contacting the first object 32. However, in some embodiments, resistive forces (e.g., friction) may prevent the complete reorientation of the vehicle 12. Therefore, one or more of the successive objects 70 may be provided to further reorient the vehicle 12 until the complete reorientation of the vehicle 12 has been achieved. As shown in FIG. 2, the flume 13 includes opposing side walls spaced apart from one another along an axis orthogonal to a direction of flow of the flow path 14. As is further shown in FIG. 2, the flume 13 includes a first section having the successive objects 70 disposed therein. The side walls of the flume 13 in the first section are spaced apart from one another (e.g., along the axis orthogonal to the direction of flow) a distance greater than the length 52 of the vehicle 12, as shown in FIG. 2 in which the vehicle 12 is midturn within the flume 13. The flume 13 further includes a second section disposed downstream 21 of the first section. As shown, the side walls of the flume 13 of the second section are narrower than those in the first section and are spaced apart from one another a distance that is less than the length 52 of the vehicle 12 and greater than the width 54 of the vehicle 12. Indeed, as shown, the side walls of the flume 13 in the second section are spaced apart a distance only slightly larger than the width 54 of the vehicle 12 such that the range of motion is limited by the side walls. In this way, the vehicle 12 may be capable performing a complete reorientation in the first section of the flume 13 (e.g., due to contact with the successive objects 70), and not in the second section of the flume 13. It should also be noted that, as mentioned above, that the vehicle 12 may be decreasing in elevation as it moves along the flow path 14. More particularly, the vehicle 12 may be moving down a slope (e.g., on a dry surface or floating on water) while the vehicle 12 contacts the one or more objects 16, which may be located at various locations and variably spaced from one another, to reorient itself (e.g., via one or more rotations of the vehicle 12) as discussed herein.

Furthermore, the vehicle 12 may also interact with a variety of other implements (e.g., objects 16) as it progresses through the water ride attraction 10. For example, the vehicle 12 may interact with one or more variable bumpers 80, one or more spoked objects 82, one or more accelerators 84, one or more sloped sections 86, one or more submerged objects 88, one or more conveyers 90, or any combination thereof.

Figure 4:
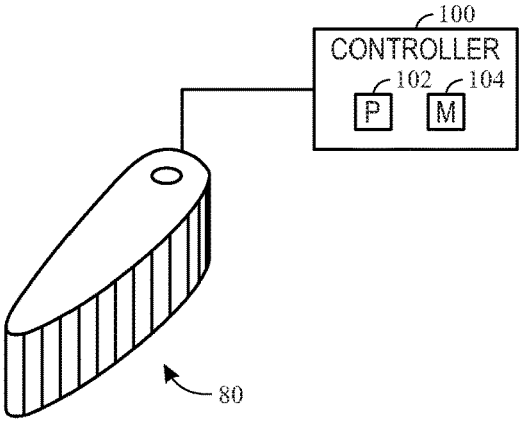
FIG. 4 is a perspective view of an embodiment of an obstacle that may be utilized to produce rotation of a ride vehicle, in accordance with the present techniques.
Figure 5:
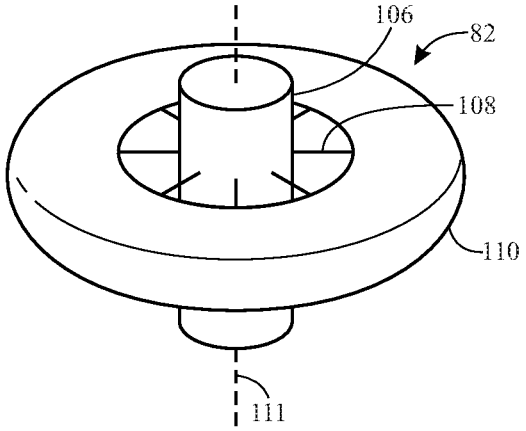
FIG. 5 is a perspective view of an embodiment of a device that may be utilized to change a direction of the ride vehicle, in accordance with the present techniques.

Referring now in parallel to FIG. 4, the water ride attraction 10 may provide a change in direction and/or orientation of the vehicle 12 via the variable bumper 80. In some embodiments, the variable bumper 80 may be actuated by a controller 100. More specifically, a position of the variable bumper 80 may be controlled via the controller 100. That is, in certain embodiments, the direct interaction of the vehicle 12 and the objects 26, such as the variable bumper 80, may not involve moving parts that actuate during each contact. However, prior to initiation of certain contacts with the ride vehicle 12 and according to a desired ride configuration, the variable bumper 80 may be reconfigured or repositioned as determined by the controller 100. In this manner, the total overall incidence of mechanical actuation is reduced relative to reorientation devices that actuate under power at each contact with the ride vehicle 12, which in turn may improve the lifespan of the ride components. In one embodiment, the bumper 80 may assume a first configuration or a second configuration and actuate between them such that vehicles 12 that encounter the bumper 80 in the first configuration are directed down a first path and vehicles that encounter the bumper 80 in the second configuration are directed down a second path. In one embodiment, the second configuration is a no-contact configuration that causes the vehicle 12 not to contact the bumper 80.

The controller 100 may be any device employing a processor 102 (which may represent one or more processors), such as an application-specific processor. The controller 100 may also include a memory device 104 for storing instructions executable by the processor 102 to perform the methods and control actions described herein for the variable bumper 80. The processor 102 may include one or more processing devices, and the memory 104 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 102 or by any general purpose or special purpose computer or other machine with a processor.

In some embodiments, the variable bumper 80 may be used to direct the vehicle 12 toward one or more flow paths. In this manner, the variable bumper 80 may direct a first subset of vehicles 12 down a first flow path and a second subset of vehicles 12 down a second flow path. In some embodiments, the variable bumper 80 may be actuated to be disposed at a particular angle, and interact with the vehicle 12 in a manner similar to the slanted object 20. Particularly, the variable bumper 80 may interact with the vehicle 12 to position the vehicle 12 at a certain angle relative to a flow path. In this embodiment, because the vehicle 12 is disposed at the certain angle relative to the flow path, the vehicle 12 may contact an object (e.g., object 16, another variable bumper 80, etc.) at a predictable distance away from the center of mass 38 of the vehicle 12 and transfer some translational kinetic energy into rotational kinetic energy, thereby rotating the vehicle 12 some degree about its center of mass 38.

The vehicle 12 may also interact with one or more spoked objects 82. The one or more spoked objects 82 may include a shaft 106, spokes 108, and a contact portion 110. In some embodiments, the spoked object 82 may rotate about an axis 111 of the shaft 106. Therefore, if the vehicle 12 contacts the spoked object 82, the spoked object 82 may rotate in the direction of movement of the vehicle 12 to maintain a speed of the vehicle 12. Additionally, or in the alternative, the spoked object 82 may be rigidly fixed relative to the axis 111 of the shaft 106. The spokes 108 may extend radially from the shaft 106 and couple to the contact portion 110. In some embodiments, the spokes 108 may extend radially beyond the contact portion 110 to interact with the vehicle 12. In some embodiments, the spokes 108 may be formed from a lightweight and water-resistant material. For example, the spokes 108 may be formed from plastic, metal, wood, rubber, etc. Further, in the current embodiment, the contact portion 110 extends circumferentially about the shaft 106 with a circular cross section. In some embodiments, however, the contact portion may be any suitable shape (e.g., circle, triangle, square, pentagon, hexagon, etc.) with any suitable cross-section (e.g., circular, triangular, rectilinear, curvilinear, etc.). Similar to the first and successive objects 32, 70, the spoked object 82 may contact the vehicle 12 at a particular distance away from the center of mass 38. Therefore, when the vehicle 12 contacts the spoked object 82 (e.g., at a location along the perimeter of the contact portion 110), some of the linear kinetic motion of the vehicle 12 may be transformed into rotational kinetic energy, thereby rotating the vehicle 12 about its center of mass 38.

Further, as discussed above, the vehicle 12 may also interact with one or more accelerators 84, one or more sloped sections 86, one or more submerged objects 88, and/or one or more conveyers 90. As illustrated in FIG. 1, the one or more accelerators 84, sloped sections 86, submerged objects 88, and/or conveyers 90 may be disposed along the water ride attraction 10 to further enhance a thrill factor of the water ride attraction 10. For example, the vehicle 12 may increase in speed as a result of interacting with an accelerator 84. More specifically, the accelerator 84 may include multiple rotating discs that may engage with a side of the vehicle 12. In some embodiments, the rotating discs may be rotating faster than a linear speed of the vehicle 12, thereby increasing the speed of the vehicle 12. In other embodiments, the rotating discs may be rotating slower than a linear speed of the vehicle 12, thereby decreasing the speed of the vehicle 12.

The one or more sloped sections 86 may also serve to increase a thrill factor 10 of the water ride attraction 10. For example, when the vehicle 12 is interacting with the sloped portion 86, a pitch and/or height of the vehicle 12 may be augmented. Similarly, one or more conveyers 90 may interact with the vehicle 12 to increase a thrill factor of the water ride attraction 10. For example, as the vehicle 12 moves along the water ride attraction 10, the vehicle 12 may slide onto, or come in contact with, the conveyer 90 at a location within the water ride attraction 10. The conveyer 90 may then transport the vehicle 12 to a different location within the water ride attraction 10. In some embodiments, the one or more conveyers 90 may be submerged, or partially submerged under the surface (e.g., water surface) of the water ride attraction 10.

Furthermore, in some embodiments, one or more of the objects 16 may be submerged, or partially submerged under the surface (e.g., water surface) of the water ride attraction 10. One such embodiment may be seen in the submerged object 88. Indeed, although currently shown as having some portion above the surface, one or more of the objects 16 (e.g., first object 32, successive objects 70, etc.) may be submerged similar the submerged object 88. As such, riders of the vehicle 12 may not have a visualization of one the submerged objects 88, thereby producing an unexpected change of motion of the vehicle 12 relative to the point of view of the rider. Further, in some embodiments, one or more of the objects 16 may be actuated to and/or from a submerged position. Further still, the one or more submerged objects 88 may function similarly as described above with regard to the first and successive objects 32, 70. Particularly, the vehicle 12 may contact the submerged object 88 at a particular distance away from the center of mass 38 of the vehicle 12. Therefore, when the vehicle 12 contacts the submerged object 88, some of the linear kinetic motion of the vehicle 12 may be transformed into rotational kinetic energy, thereby rotating the vehicle 12 about its center of mass 38.

In some embodiments, it may be desirable for the vehicle 12 to move efficiently and maintain a speed as it moves through the water ride attraction 10. As such, it may be beneficial to reduce friction between the vehicle 12 and elements (e.g., objects 16, flume 13, etc.) of the water ride attraction 10. Accordingly, a portion, or all, of the objects 16 and/or the flume 13 may include rollers 112 disposed at the edge of the objects 16 and/or flume 13. Therefore, when the vehicle 12 comes into contact with one or more of the objects 16 and/or flume 13, the vehicle 12 may come into contact with one or more rollers 112. Therefore, in some embodiment, the vehicle 12 may conserve more momentum and/or speed after contacting the one or more objects 16 and/or flumes 13 via the rollers 112. Furthermore, in the interest of momentum/speed conservation, one or more roller 122 may also be disposed on the perimeter of the vehicle 12.

Further, the impact of the vehicle 12 on the objects 16 and/or flume 13 may be cushioned. For example, the vehicle 12 and/or the objects 16 may be equipped with a damping material 76. In some embodiments, the damping material 76 may be a soft rubber material, a foam material, packaged air, etc. Essentially, the damping material 76 may be any structure and/or material that may soften the impact of the vehicle 12 on any element (e.g., objects 16, rollers 112, flume 13, etc.) of the water ride attraction 10.

To further enhance the thrill factor of the water ride attraction 10, the water ride attraction 10 may include one or more characters 114. In some embodiments, one or more of the characters 114 may be implemented as the objects 16. The characters may be any suitable character in accordance with a narrative (e.g., theme) of the water ride attraction 10.

As provided herein, the vehicle 12 may not include a power system to produce movement. Further, the vehicle 12 may be trackless. Indeed, in some embodiments, a hull (e.g. bottom) of the vehicle 12 may be flat, rounded, and/or include one or more fins. Further, in some instances as the vehicle 12 progresses through the water ride attraction 10, the vehicle 12 may be disposed perpendicular relative to a flow path (e.g., flow path 14). As such, in some embodiments, to enhance stability of the vehicle 12, the water ride attraction 10 (e.g., the flume 13) may be equipped with a false floor 118. For example, the false floor 118 may include a series of beams that may be coupled to a floor of the flume 13 and arranged substantially parallel to the flow path 14. In some embodiments, if the vehicle 12 is positioned horizontally (e.g., perpendicularly) relative to the flow path 14, the vehicle 12 may list (e.g., pitch, rotate about a longitudinal axis, roll to a side). As the vehicle 12 lists, a bottom edge of the vehicle 12 may contact one or more of the beams of the false floor 118, thus preventing the vehicle 12 from rolling over while listing.

Figure 6:
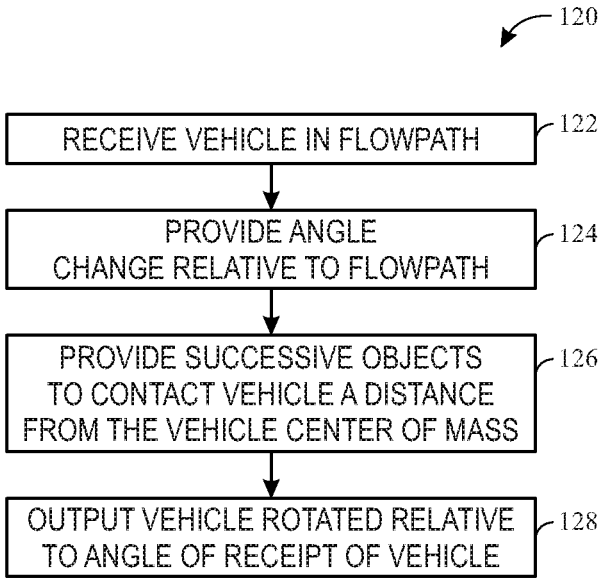
FIG. 6 is a flow diagram of a method for rotating a ride vehicle, in accordance with the present techniques.

FIG. 6 is a flow chart of a vehicle rotation method 120, in accordance with an embodiment. At the start of the method 120, the water ride attraction 10 may receive the vehicle 12 at a first orientation substantially parallel to a flow path (e.g., flow path 14) (block 122). However, in some embodiments, the vehicle 12 may be disposed at an orientation offset relative to the direction of the flow path.

Regardless of the angle of the vehicle 12 relative to the flow path, the vehicle 12 may interact with an angled object (e.g., angled object 20) that has a contact or interaction surface oriented at a first angle relative to direction of the flow path. For example, an imaginary line along the direction of the flow path and the angled surface may form the first angle. After interaction with the angled object, the vehicle 12 may be disposed (e.g., rotated) at a second angle (e.g., second angle 26) relative to the flow path (block 124). Indeed, each vehicle 12 (e.g., each successive vehicle 12 that the water ride attraction 10 may receive) that interacts with the angled object may be reliably and predictably disposed at the second angle after the interaction with the angled object.

Further, one or more successive objects (e.g. first object 32, successive objects 70) may be disposed along and/or near the flow path to contact the vehicle 12 in series as the vehicle 12 moves along the flow path (block 126). Indeed, as a result of interaction with the angled object, each successive vehicle 12 may approach the one or more successive objects (e.g., first object 32, successive objects 70) at the second angle. Thus, the vehicle 12 may contact a first object of the one or more successive objects while disposed at the second angle. In this manner, each vehicle 12 may contact the first object at a constant (e.g., predictable) location (e.g., contact point 39) along the length of the vehicle 12. Contacting the vehicle 12 with the first object at the constant location may result in the vehicle 12 experiencing a reaction force (e.g., reaction force 40). Due at least in part to the predictable second angle and the constant location, the reaction force on the vehicle 12 may be at a constant and predictable distance (e.g., defined as the perpendicular distance of the reaction force relative to the direction of momentum of the vehicle) away from the center of mass of the vehicle. Due at least in part to the constant and predictable distance of the reaction force, each vehicle may rotate a certain amount after contacting the first object. Indeed, the reaction force of each vehicle 12 contacting the one or more successive objects may also include a predictable and constant magnitude of the reaction force for each vehicle 12. More specifically, contacting the vehicle 12 with one or more successive objects may interrupt linear motion (e.g. momentum) of the vehicle, thereby transferring the linear motion into rotational motion (e.g., momentum), thereby rotating the vehicle 12.

The vehicle 12 may then contact each of the other successive objects in a manner similarly as described above with respect to contact with the first object. After interacting with the successive objects, the vehicle may have rotated to a desired orientation, which in some embodiments, may be a complete reversal of orientation relative to the orientation at which the water ride attraction 10 received the vehicle 12 (block 122) (e.g., a front to back and/or a back to front reversal). The vehicle 12 may then exit the flow path with the desired orientation (block 128).

Figure 7:
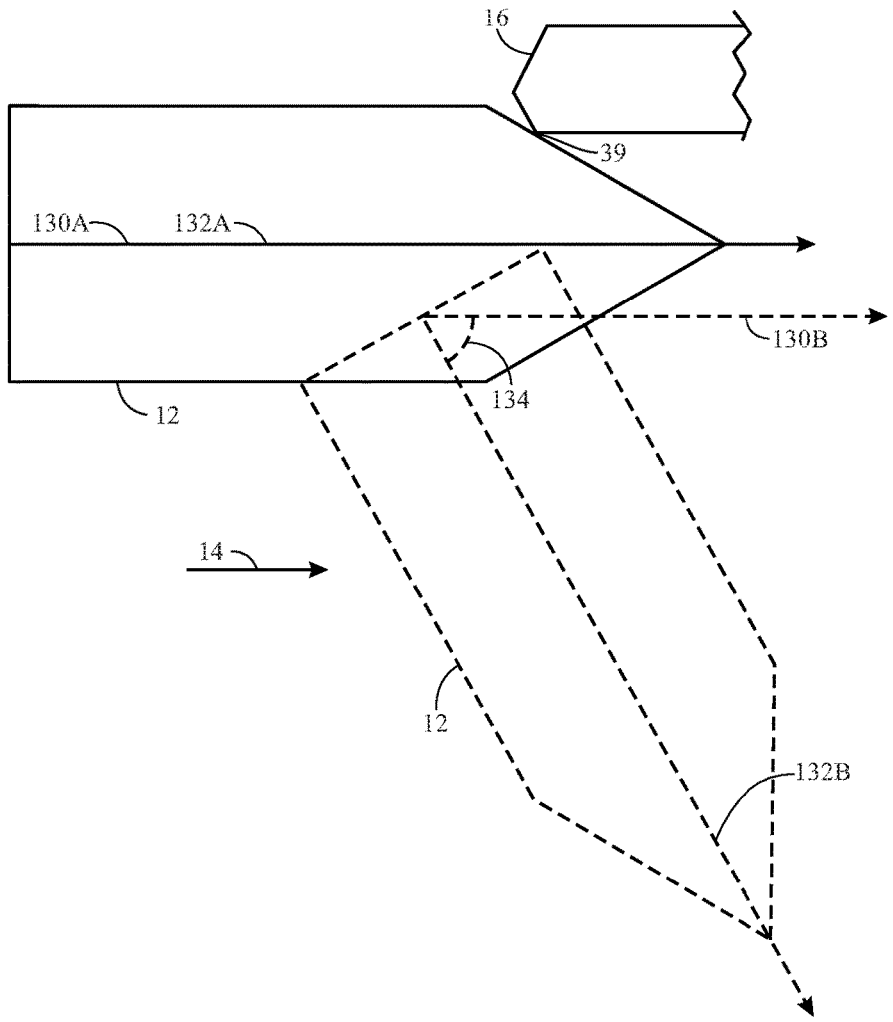
FIG. 7 shows a change in orientation angle after contact with an object, in accordance with the present techniques.

Referring to FIG. 7, the orientation angle of the vehicle 12 relative to the flow path 14 may be determined by extending an imaginary line 130 in the direction of the flow path 14 from a point (e.g., a midpoint or a rearmost point of the vehicle) on the vehicle 12 and determining the angle between the flow path imaginary line 130 and a second imaginary line 132 through the ride vehicle. For example, the second imaginary line 132 may be formed through a longest dimension of the ride vehicle 12. Changes in orientation may be changes in the angle (e.g., angle 134) formed by the ride vehicle 12 relative to the flow path imaginary line 130 (e.g., the flow path 14 or the direction of momentum 41, see FIG. 2). As shown in FIG. 7, at a first position, the first imaginary line 130*a* and the second imaginary line 132*a* are approximately parallel, indicating that the vehicle 12 is generally oriented along a direction of the flow path 14. In such an orientation, the angle formed by the first imaginary line 130*a* and the second imaginary line 132*a* is zero. After encountering the object 16 and after contact at the contact location or contact point 39, the vehicle 12 is both translated across the flow path 14 and angularly displaced by an angle 134 relative to the imaginary line 130 (e.g., flow path 14 direction). Successive angular displacements may be measured relative to an absolute flow path 14 direction or relative to an initial vehicle position. That is, the change in orientation may be measured by setting the initial angle to zero before contact with each object 16 and measuring an angular displacement after contact. The angular displacement may be at least 15 degrees, at least 30 degrees, at least 45 degrees, or at least 60 degrees. Further, the angular displacement may be generally predictable for successive vehicles 12 travelling along the flow path 14, and may be in a limited range of 15-45 degrees, 30-60 degrees, 30-45 degrees, 45-60 degrees, 45-90 degrees, 60-90 degrees, 90-120 degrees, etc.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a flume providing a flow path, wherein the flume comprises opposing side walls spaced apart from one another along an axis orthogonal to a direction of flow of the flow path;

one or more vehicles configured to accommodate one or more passengers and configured to move along the flow path in the flume, wherein the one or more vehicles are associated with a length and a width, and the length is longer than the width; and one or more objects protruding into the flow path, wherein the one or more objects are positioned in the flow path such that the one or more objects are configured to contact a vehicle of the one or more vehicles as the vehicle moves along the flow path and at a contact location on an exterior of the vehicle, wherein the contact location is spaced apart a distance from a center of mass of the vehicle to change a direction or orientation of the vehicle relative to the flow path after the contact location of the vehicle contacts the one or more objects, wherein the flume comprises a first section having the one or more objects disposed therein, wherein the one or more objects are configured to change the direction or orientation of the vehicle relative to the flow path within the first section, wherein the flume comprises a second section configured to direct the vehicle along the flow path, and wherein a first distance between the opposing side walls of the first section is greater than the length of the vehicle and wherein the opposing side walls of the second section are spaced apart from one another a distance less than the length of the vehicle such that the vehicle is capable of rotating to cause a complete reorientation of the vehicle within the first section and not the second section.

2. The system of claim 1, wherein the flume is filled with fluid and wherein a portion of the one or more objects is submerged below a fluid surface of the flow path.

3. The system of claim 1, wherein the one or more objects are positioned within the flume away from and not in contact with a side wall of the flume defining the flow path.

4. The system of claim 1, wherein a portion of the one or more objects is oriented orthogonally to a flow direction of the flow path.

5. The system of claim 1, wherein the one or more objects comprises a wheel comprising spokes extending radially from a shaft and configured to contact the vehicle to cause the wheel to rotate.

6. The system of claim 1, wherein a portion of the one or more objects is formed from a rubber material, a pliable material, an air-filled material, or any combination thereof.

7. The system of claim 1, wherein the vehicle comprises a damping material disposed about the exterior and at the contact location, wherein the damping material is formed from a rubber material, a pliable material, an air-filled material, or any combination thereof.

8. The system of claim 1, wherein the contact location is located on an end section of the vehicle.

9. The system of claim 1, wherein the contact location comprises a region on the exterior within 3 meters of a contact point.

10. The system of claim 9, wherein a second distance between the contact point and the center of mass is at least 30% of a total distance of a longest dimension of the vehicle.

11. The system of claim 1, wherein the contact location comprises a region on the exterior within 1 meter of a contact point.

12. The system of claim 1, wherein the one or more objects comprise a plurality of objects spaced apart from each other within the flow path and wherein each object of the plurality of objects is positioned in the flow path such that each object contacts the vehicle at or near a contact point on the vehicle.

13. The system of claim 1, wherein the one or more objects comprise a plurality of objects spaced apart from each other within the flow path and wherein each object of the plurality of objects is positioned in the flow path such that each object contacts the vehicle to cause at least a 180 degree change in orientation of the vehicle as a result of cumulative changes in orientation.

14. The system of claim 13, wherein the 180 degree change in orientation is a reversal from forward-facing to backward-facing.

15. A method, comprising:

providing a water ride attraction comprising a flume forming one or more intersections of a plurality of flow paths;

providing one or more vehicles configured to move along the plurality of flow paths;

providing one or more variable objects positioned within the flume, wherein each of the one or more variable objects is configured to be individually actuated between a first configuration and a second configuration within the flume;

contacting a first vehicle with an individual variable object in the first configuration at a first contact point on a first exterior of the first vehicle to adjust a first vehicle orientation of the first vehicle by a first displacement angle and to cause the first vehicle to enter a first flow path of the plurality of flow paths;

actuating the individual variable object to the second configuration; and contacting a second vehicle with the individual variable object in the second configuration at a second contact point on a second exterior of the second vehicle to adjust a second vehicle orientation of the second vehicle by a second displacement angle different from the first displacement angle and to cause the second vehicle to enter a second flow path of the plurality of flow paths.

16. The method of claim 15, wherein the second vehicle does not enter the first flow path.

* * * * *